US005249720A

United States Patent [19]

White

[11] Patent Number: 5,249,720

[45] Date of Patent: Oct. 5, 1993

[54] TOOL FOR FACILITATING APPLICATION OF ELASTIC STOCKINGS

[76] Inventor: Allen A. White, R.F.D. 2, Box 9, Peabody, Kans. 66866

[21] Appl. No.: 876,769

[22] Filed: May 1, 1992

[51] Int. Cl.[5] ..... A47G 25/90

[52] U.S. Cl. ..... 223/112; 81/303; 81/331; 294/106

[58] Field of Search ..... 223/111, 112, 115, 116; 294/106, 16; 81/303, 310, 309, 300, 307, 306, 315, 331

[56] References Cited

U.S. PATENT DOCUMENTS

| | | | |
|---|---|---|---|
| 131,188 | 9/1872 | Sneider | 81/307 |
| 1,092,104 | 3/1914 | Hill | 294/106 |
| 1,095,054 | 4/1914 | Wiesenfeld | 294/106 |
| 1,315,096 | 9/1919 | Deiley . | |
| 1,539,526 | 5/1925 | Swickard | 81/303 |
| 1,884,643 | 10/1932 | Forbes . | |
| 2,173,010 | 9/1939 | De Amario | 81/331 |
| 2,196,441 | 4/1940 | Knapp | 81/303 |
| 2,214,985 | 9/1940 | Bachmann | 81/303 |
| 2,840,082 | 6/1958 | Salvatore . | |
| 3,263,535 | 8/1966 | Zurcher . | |
| 3,310,209 | 3/1967 | Clauss . | |
| 3,727,812 | 4/1973 | Weiss . | |
| 3,853,252 | 12/1974 | Scianimanico . | |
| 3,869,793 | 3/1975 | Ferguson | 81/331 |
| 3,916,907 | 11/1975 | Peterson . | |
| 4,072,255 | 2/1978 | Bogorad . | |
| 4,789,087 | 12/1988 | Doorenbos . | |

*Primary Examiner*—Clifford D. Crowder
*Assistant Examiner*—Bibhu Mohanty
*Attorney, Agent, or Firm*—Shook, Hardy & Bacon

[57] ABSTRACT

A tool is provided for use in applying support stockings and other types of socks to an individual's feet and legs. The tool includes a tongue positioned between side rails which are connected to handles that can be manipulated to cause lateral movement of the side rails and stretching of the stocking. The tongue is moveable laterally when the side rails are pivoted inwardly to facilitate application of the stocking to the tool. The tongue includes an extension which is engaged by the handles to cause centering of the tongue between the side rails when they are pivoted laterally outward.

17 Claims, 1 Drawing Sheet

TOOL FOR FACILITATING APPLICATION OF ELASTIC STOCKINGS

BACKGROUND OF THE INVENTION

This invention relates in general to orthopedic devices and, more particularly, to a tool for facilitating the application of elastic or support stockings to an individual's leg.

Many individuals with circulatory disorders are required to wear tight-fitting hosiery or stockings which are designed to support the legs and reduce the pooling of fluids in the legs and feet of the individual. Because of the strongly elastic nature of these stockings, many persons find it difficult to exert the force needed to apply the stockings over their feet and legs. In addition, there are numerous individuals who lack the flexibility to bend their legs or body to the degree needed to apply support stockings or even socks.

In order to aid those individuals who find it difficult to put on support stockings as well as socks, numerous devices have been devised which can be manipulated by the user to facilitate application of the stockings. Examples of these devices are disclosed in U.S. Pat. No. 1,315,096 to Deiley, U.S. Pat. No. 3,727,812 to Weiss, U.S. Pat. No. 3,310,209 to Clauss, U.S. Pat. No. 3,853,252 to Scianimanico, U.S. Pat. No. 4,072,255 to Bogorad and U.S. Pat. No. 4,789,087 to Doorenbos.

The patent to Doorenbos discloses a tongue portion which aids in the stretching of the stocking and also engages the individual's heel to facilitate application of the stocking. The tongue operates most effectively when it is centered between the lateral stretching members of the tool which are used to cause sideways stretching of the stocking. Doorenbos achieves the centering of the tongue by splitting the tongue into two segments which move with the lateral stretching members. In order to protect against pinching of the user's foot or leg, Doorenbos proposes the use of a guard which is connected to one of the tongue segments and overlaps the other tongue segment so that the user is shielded from the pinching action of the tongue segments when they are brought into engagement. While the guard operates in generally satisfactory fashion, it would be desirable to utilize a single piece tongue which can be centered between the lateral stretching members and which eliminates the risk of pinching the individual's foot or leg so that the use of a guard is not required.

SUMMARY OF THE INVENTION

It is an object of this invention to provide a tool for use in application of stockings, including those which are strongly elastic, and which includes a tongue which can be moved generally independently of the side stretching members through a limited range of movement to facilitate placement of the stocking on the tool but which is automatically returned to a centered position when the side members are moved laterally outward to cause stretching of the stocking, whereby the tongue is positioned in the desired centered position to facilitate application of the stocking to an individual's leg.

It is also an object of this invention to provide a tool as described which maintains the tongue in the centered position during application of the stocking to an individual's leg so that the tongue provides a rigid surface which assists in the movement of the tool along the user's foot and leg.

To accomplish these and other related objects of the invention, the invention is directed to a tool for use in application of a stocking to an individual's leg, said tool comprising:

a pair of side rails which are mounted for lateral pivoting movement between a first position in which the side rails have been moved toward each other to facilitate placement of the stocking over said side rails and removal therefrom and a second position in which the side rails have been moved laterally outward to cause stretching of the socking;

a pair of handles coupled with the side rails and manipulable for effecting said lateral pivoting movement of the side rails; and a tongue mounted for lateral pivoting movement when the side rails are in said first position, said tongue including an extension which is engageable by the handles to cause centering of the tongue between the side rails when the side rails are moved laterally outwardly to the second position.

The tool is used by moving the side rails together to the first position to allow the stocking to be slipped over the side rails and the tongue. The side rails are then moved laterally outward to the second position to cause stretching of the stocking. The individual may then insert the foot into the stretched apart stocking, using the tongue as a rigid guide much like a shoe horn.

BRIEF DESCRIPTION OF THE DRAWINGS

In the accompanying drawings which form a part of the specification and are to be read in conjunction therewith, and in which like reference numerals are used to indicate like parts in the various views.

DESCRIPTION OF THE PREFERRED EMBODIMENT

Figure 1:
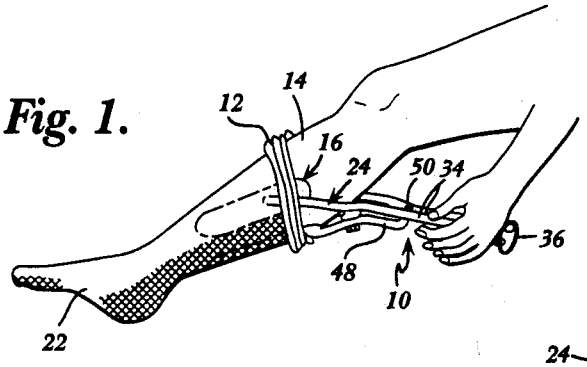
FIG. 1 is a side elevational view of a tool in accordance with the present invention being utilized to facilitate application of an elastic support hose or stocking to an individual's leg.
Figure 2:
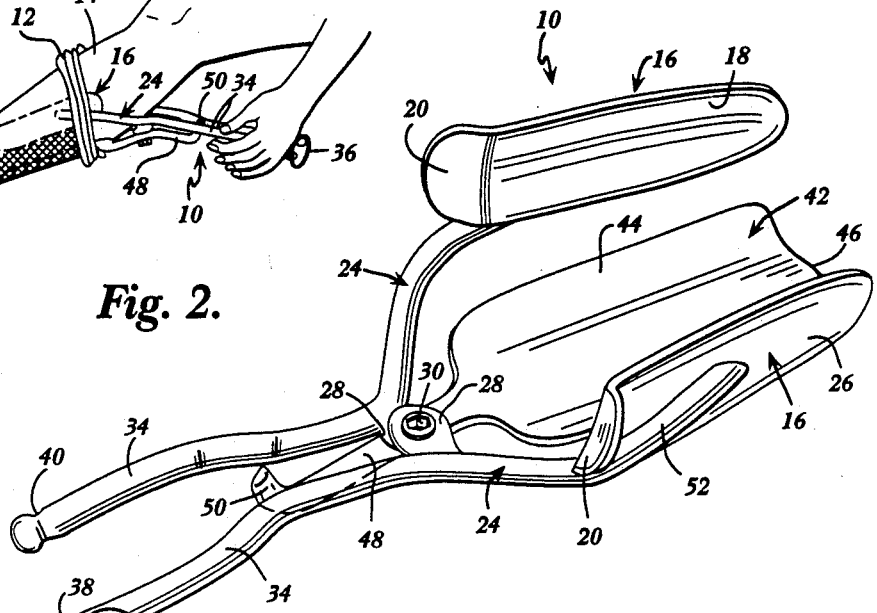
FIG. 2 is a top perspective view of the tool shown in FIG. 1 but shown on an enlarged scale.
Figure 3:
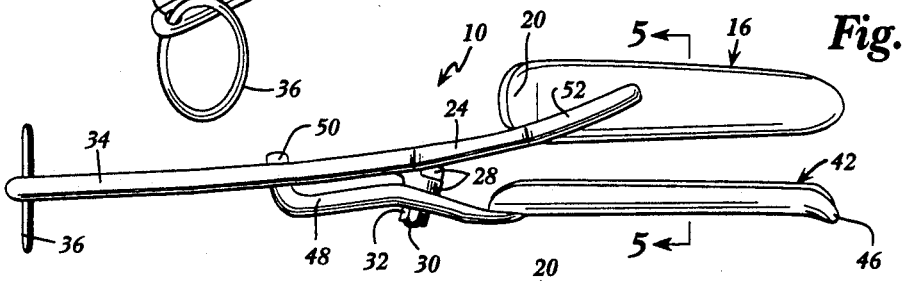
FIG. 3 is a side elevational view of the tool.

Referring now to the drawings in greater detail, a tool in accordance with the present invention is represented broadly by the numeral 10. Tool 10 is constructed for use in applying a stocking 12 to an individual's leg 14. The stocking 12 can be a highly elastic support stocking useful in the treatment of circulatory disorders or it can be an ordinary sock.

The tool 10 includes a pair of side rails 16 which are elongated and have slightly concave facing surfaces 18. The side rails 16 each include an end portion 20 which is bent outwardly to prevent the stocking 12 from slipping upwardly too far and to prevent abrasive contact of the edge of the end portions 20 with the individual's leg 18 when the leg is positioned between the side rails.

The bent end portions 20 also serve to help guide the individual's foot 22 into the region between the side rails 16 when the foot is first being inserted into the stocking 12.

The side rails 16 are each mounted to a rod 24 which is suitably secured such as by welding to an outer face 26 of the associated side rail 16. The rods 24 are curvilinear and include overlapping ears 28 which are secured together by a bolt 30 and nut 32. The bolt 30 serves as an axis about which the rods 24 may pivot to move the side rails 16 closer together or farther apart.

The rods 24 extend beyond the pivot axis defined by bolt 30 to form handles 34 which may be grasped by the user of tool 10 and manipulated to cause the lateral movement of side rails 16. A latch in the form of a ring 36 extends through a hole 38 in the end of one of handles 34 and may be positioned over the other handle 34 to lock the handles together and prevent their separation. A circumferential groove 40 is provided in the other handle 34 to receive and seat ring 36.

Figure 4:
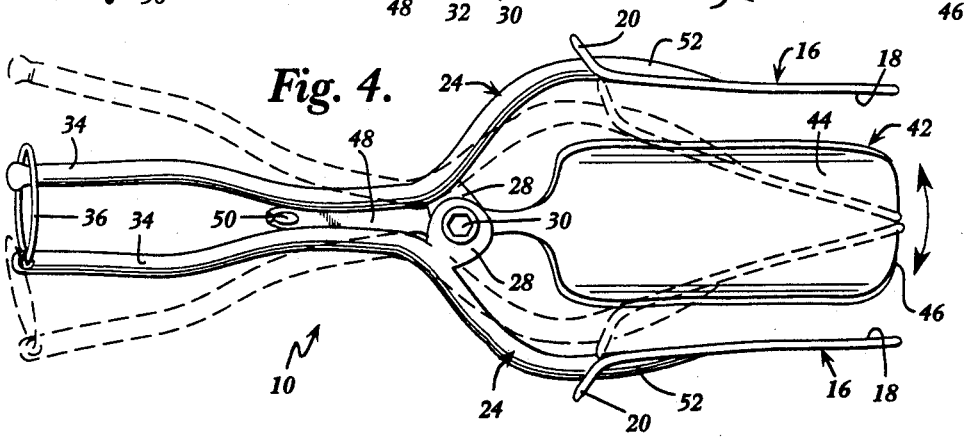
FIG. 4 is a top plan view of the tool shown with side rails that engage the support hose being locked in a outwardly spread position and with broken lines being used to illustrate the position of the side rails and handles when the support stocking is being applied thereto.
Figure 5:
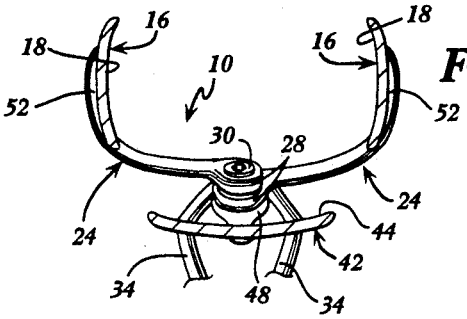
FIG. 5 is a front elevational view of the tool taken in vertical section along line 5—5 of FIG. 3 in the direction of the arrows.

The tool 10 also includes a tongue 42 which is positioned in a plane underlying the side rails 16. The tongue 42 has a slightly concave upper surface 44 and a downturned forward lip 46. The tongue 42 is secured to an extension member 48 which is mounted with rods 24 on bolt 30 to allow the tongue to be pivoted laterally. The extension member 48 extends partially along and underneath handles 34 and includes an upturned end 50 which extends into the plane of the handles 34 for engagement therewith. The extension member 48 is thus centered between the handles 34 when the handles are brought together as shown in FIG. 4. Centering of extension member 48 likewise causes centering of tongue 42 between the side rails 16. When the handles are released and moved apart as indicated by the broken lines in FIG. 4, the extension member 48 is free to move laterally within a limited range of movement between the spread apart handles 34. The tongue 42 is likewise able to move laterally within the plane underlying the side rails 16.

The tool 10 further includes a pair of protuberances 52 which are formed by the portion of each rod 24 which lies along the outer face 26 of side rail 16. These protuberances 52 are designed to engage the stocking 12 to prevent it from inadvertently sliding off of the side rails 16 while the stocking is being applied to the individual's leg 14. Desirably the protuberances are free of any sharp corners or edges which might cause snagging of the stocking 12.

In use, the tool is inserted into the open end of stocking 12 while the side rails 16 are moved laterally inwardly to a position in which they are closely spaced together at their leading ends. The stocking 12 is then moved along the outer faces 26 of the side rails 16 and along the undersurface of tongue until the stocking overlaps the protuberances 52. The handles 34 on tool 10 are then squeezed together to cause lateral spreading of the side rails 16 and stretching of the stocking 12. The tool 10 may be locked in this position by placement of latch ring 36 over the other handle 34. The ring 36 thus counteracts the elastic force exerted by the stocking 12 on side rails 16 and maintains them in the spread apart position. The foot 22 of the individual may then be inserted into the stocking 12 and the tool 10 is then used to move the stocking upwardly onto the leg 14. Once the stocking 12 has been placed in the desired position, the ring 36 may be disengaged from the other handle 34 to allow removal of tool 10 from stocking 12.

It will be appreciated that the tongue 42 greatly facilitates application of stocking 12 by providing a rigid surface against which the individual may exert a force with the heel and other portions of leg 14. Although the tongue 42 is restricted from lateral movement when the handles 34 are brought together and the stocking 12 is being applied to leg 14, the tongue 42 is provided with a limited range of movement when the handles 34 are spread apart, such as for application of the stocking to the tool 10 or removal of the stocking therefrom. This movement can facilitate the placement of tongue 42 into the desired lateral position in relation to the overlying side rails during placement of stocking 12 on tool 10. For example, it may be desirable to swing the tongue 42 laterally away from the side rails 16 to allow the stocking to be first applied to the tongue and then swung back to a centered position for stretching of the stocking over the side rails 16. Notably, the downturned lip 46 on tongue 42 serves to prevent slippage of the stocking 12 off of the tongue during this procedure.

The tool 10 thus provides an easily operable mechanism which greatly facilitates the application of the stocking 12 to leg 14 even by individuals with limited strength or flexibility. Because the handles 34 can be operated with one hand and are spaced a significant distance from the portion of tool 10 to which stocking 12 is applied, the individual can easily place the stocking 12 over foot 22 with only a slight amount of bending required.

From the foregoing, it will be seen that this invention is one well adapted to attain all the ends and objects hereinabove set forth together with other advantages which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A tool for use in application of a stocking to an individual's leg, said tool comprising:

a pair of side rails for receiving a stocking and causing stretching thereof, said side rails being mounted for lateral pivoting movement between a first position in which the side rials have been moved toward each other to facilitate placement of the stocking over said side rails and a second position in which the side rails have been moved laterally outward to cause stretching of the stocking;

a pair of handles coupled to the side rails and manipulable for effecting said lateral pivoting movement of the side rails, wherein movement of said handles toward each other causes movement of the side rails toward the second position with the side rails moved laterally outward; and a tongue providing an upper surface for contacting a portion of the individuals leg during the application of the stocking thereto, said tongue being mounted for lateral pivoting movement relative to said side rails and handles when the side rails are in said first position, said tongue including an extension which is engageable by the handles to cause centering of the tongue between the side rails when the side rails are move laterally outwardly to the second position.

2. The tool as set forth in claim 1, including a latch mounted for releasably securing the handles together to prevent movement of the side rails laterally inwardly from the second position.

3. The tool as set forth in claim 2, including a protuberance on a laterally outer surface of at least one of the side rails for engaging the stocking when applied to the side rails to resist slippage of the stocking along the side rail.

4. The tool as set forth in claim 3, wherein one of said handles is connected to one of said side rails and the other of said handles is connected to the other of said side rails and wherein said handles and side rails are mounted for pivoting about a common axis.

5. The tool as set forth in claim 4, wherein said tongue is mounted for pivoting about said common axis.

6. The tool as set forth in claim 5, including an outwardly bent end portion adjacent the common axis on at least one of the pair of side rails.

7. A tool for use in application of a stocking to an individual's leg, said tool comprising:

a pair of side rails having facing concave surfaces, said side rails being mounted for lateral pivoting movement between a first position in which the side rails have been moved toward each other to facilitate placement of the stocking over said side rails and and a second position in which the side rails have been moved laterally outward to cause stretching of the stocking;

a pair of handles coupled with the side rails and manipulable for effecting said lateral pivoting movement of the side rails;

a tongue mounted for lateral pivoting movement in a plane underlying the side rails, said tongue having an upwardly concave surface for contacting a portion of the individual's leg during application of the stocking thereto; and an extension connected to said tongue for pivoting movement therewith and extending between the handles, said extension including a portion which is engageable by the handles when the handles are brought together to move the side rails laterally outwardly to the second position, whereby the tongue is centered between the side rails when the extension portion is in contact with both handles.

8. The tool as set forth in claim 7, including a latch mounted for releasably securing the handles together to prevent movement of the side rails laterally inwardly from the second position.

9. The tool as set forth in claim 8, including a protuberance on a laterally outer surface of at least one of the side rails for engaging the stocking when applied to the side rails to resist slippage of the stocking along the side rail.

10. The tool as set forth in claim 9, wherein one of said handles is connected to one of said side rails and the other of said handles is connected to the other of said side rails and wherein said handles and side rails are mounted for pivoting about a common axis.

11. The tool as set forth in claim 10, wherein said tongue is mounted for pivoting about said common axis.

12. The tool as set forth in claim 11, including an outwardly bent end portion adjacent the common axis on at least one of the pair of side rails.

13. A tool for use in application of a stocking to an individual's leg, said tool comprising:

a pair of side rails for receiving a stocking and causing stretching thereof, said side rails being mounted for lateral pivoting movement between a first position in which the side rails are moved toward each other to facilitate placement of the stocking over said side rails and removal therefrom and a second position in which the side rails are moved laterally outward to cause stretching of the stocking;

a pair of handles coupled with the side rails and manipulable for effecting said lateral pivoting movement of the side rails;

a tongue having an upwardly concave surface for contacting a portion of the individual's leg during application of the stocking thereof, said tongue being mounted for lateral pivoting movement to facilitate placement of the stocking over the tongue when the side rails are in said first position;

an extension mounted on the tongue and engageable by the handles to cause centering of the tongue between the side rails when the handles are manipulated to move the side rails laterally outwardly to the second position; and a latch mounted for releasably securing the handles together to prevent movement of the side rails laterally inwardly from the second position.

14. The tool as set forth in claim 13, including a protuberance on a laterally outer surface of at least one of the side rails for engaging the stocking when applied to the side rails to resist slippage of the stocking along the side rail.

15. The tool as set forth in claim 14, wherein one of said handles is connected to one of said side rails and the other of said handles is connected to the other of said side rails and wherein said handles and side rails are mounted for pivoting about a common axis.

16. The tool as set forth in claim 15, wherein said tongue is mounted for pivoting about said common axis.

17. The tool as set forth in claim 16, including an outwardly bent end portion adjacent the common axis on at least one of the pair of side rails.

* * * * *

UNITED STATES PATENT AND TRADEMARK OFFICE

CERTIFICATE OF CORRECTION

PATENT NO. : 5,249,720

DATED : October 5, 1993

INVENTOR(S) : Allen A. White

It is certified that error appears in the above-identified patent and that said Letters Patent is hereby corrected as shown below:

Column 4, line 51 of the patent, delete the word "rials" and insert the word --rails--.

Signed and Sealed this

Fifth Day of April, 1994

Bruce Lehman

*Attest:*

BRUCE LEHMAN

*Attesting Officer*

*Commissioner of Patents and Trademarks*